US010446998B2

(12) United States Patent
Felices et al.

(10) Patent No.: US 10,446,998 B2
(45) Date of Patent: Oct. 15, 2019

(54) DEVICE AND METHOD FOR FITTING CONNECTOR HOUSINGS PROVIDED WITH SEALING MATS

(71) Applicant: KOMAX HOLDING AG, Dierikon (CH)

(72) Inventors: Jean-Luc Felices, Marignane (FR); Beat Estermann, Dierikon (CH); Markus Kiser, Büren (CH); Simon Hugener, Ennetbürgen (CH)

(73) Assignee: KOMAX HOLDING AG, Dierikon (CH)

( * ) Notice: Subject to any disclaimer, the term of this patent is extended or adjusted under 35 U.S.C. 154(b) by 0 days.

(21) Appl. No.: 15/954,721

(22) Filed: Apr. 17, 2018

(65) Prior Publication Data

US 2018/0316152 A1 Nov. 1, 2018

(30) Foreign Application Priority Data

Apr. 28, 2017 (EP) ..... 17168587

(51) Int. Cl.
*H01R 43/22* (2006.01)
*H01R 13/52* (2006.01)
*H01R 43/20* (2006.01)

(52) U.S. Cl.
CPC ..... *H01R 43/22* (2013.01); *H01R 13/521* (2013.01); *H01R 13/5216* (2013.01); *H01R 43/20* (2013.01); *H01R 13/5208* (2013.01)

(58) Field of Classification Search
CPC ..... H01R 43/20; H01R 43/015; H01R 43/00; Y10T 29/53217; H05K 13/06
USPC ..... 29/748, 749
See application file for complete search history.

(56) References Cited

U.S. PATENT DOCUMENTS

| | | | | |
|---|---|---|---|---|
| 3,110,093 A * | 11/1963 | Johnson | H01R 13/426 254/134.3 R |
| 3,789,484 A * | 2/1974 | Morgan | H01R 43/22 29/747 |
| 4,171,565 A | 10/1979 | Boudreau et al. | |
| 4,351,109 A * | 9/1982 | Kelly | H01R 43/22 29/747 |
| 4,433,476 A | 2/1984 | Bailey et al. | |
| 4,631,817 A | 12/1986 | Bailey et al. | |
| 4,787,138 A | 11/1988 | Eaton et al. | |
| 4,967,470 A * | 11/1990 | Folk | H01R 43/20 29/747 |

(Continued)

FOREIGN PATENT DOCUMENTS

| | | |
|---|---|---|
| DE | 1690252 A1 | 5/1971 |
| EP | 0534822 A1 | 3/1993 |

(Continued)

*Primary Examiner* — Hien D Vu
(74) *Attorney, Agent, or Firm* — William J. Clemens; Shumaker, Loop & Kendrick, LLP

(57) ABSTRACT

A device for fitting a connector housing provided with a sealing mat to a prefabricated cable end of a cable includes a fitting unit with a cable gripper having an insertion element. The cable end can be introduced into the connector housing with the fitting unit, wherein the sealing mat has a cable through-hole that can receive the cable in a sealing manner. The insertion element is guided through the cable through-hole of the sealing mat during the fitting process. The insertion element has a shaft and a widened tip.

13 Claims, 4 Drawing Sheets

(56) References Cited

U.S. PATENT DOCUMENTS

| | | | |
|---|---|---|---|
| 5,903,970 | A | 5/1999 | Pittau |
| 8,646,822 | B2 | 2/2014 | Braun et al. |

FOREIGN PATENT DOCUMENTS

| | | | |
|---|---|---|---|
| EP | 0650232 | A1 | 4/1995 |
| EP | 0848462 | A2 | 6/1998 |
| EP | 2317613 | A1 | 5/2011 |
| FR | 2450511 | A1 | 9/1980 |
| GB | 1058900 | A | 2/1967 |
| GB | 1371916 | A | 10/1974 |

* cited by examiner

DEVICE AND METHOD FOR FITTING CONNECTOR HOUSINGS PROVIDED WITH SEALING MATS

FIELD

The invention relates to a device for fitting connector housings provided with sealing mats to prefabricated cable ends of cables and a method for fitting such connector housings.

BACKGROUND

The fitting is accomplished by means of a fitting unit with which the cable ends may be introduced into cells of the connector housing to be fitted. Such fitting devices are frequently downstream of fabrication systems. The fitting device could also be a component of a fabrication system, however. A fabrication system may comprise, for example, a stripping station for cutting and stripping the electrical cable, crimping stations for adding crimp contacts to the stripped cable ends, and, where necessary, socket stations. For high-value electrical connectors, contacts in the form of pins or sleeves that may be added to the stripped cable ends using appropriate processing stations may be used instead of crimp contacts.

Sealing mats seal connector housings against dust, moisture, and water, and are used, for example, in the aircraft industry. Mil-C-26500 type connectors that have connectors equipped with connector housings provided with sealing mats are representative of this type of connector. A connector housing provided with sealing mats that is for producing electrical connectors is also illustrated and described in GB 1 371 916 A, for example.

Also known from the aforesaid GB 1 371 916 A is a manual tool for fitting a connector housing provided with a sealing mat to prefabricated cable ends. The cable ends have contacts, embodied as pins, that together with the cable are placed into the tool and then pushed through the cable through-holes into the sealing mat by means of the tool. The contact in the connector housing is locked using a collar arranged on the pin, whereupon the manual tool may be withdrawn again.

Fitting devices that permit mass production are also known and commonly used. Connector housings having a plurality of cells and small cell intervals may be fitted to prefabricated cable ends using these fitting devices in an automated fitting process. EP 2 317 613 A1 depicts a fitting device having a cable gripper that has two gripping jaws. For fitting connector housings provided with sealing mats, the cable gripper grips the cable near the contact and, in a number of steps, pushes the cable into the sealing mat, wherein the cable gripper moves back a small distance each time and then re-grips the cable further back. In practice it has been found that this "regripping process" is not suitable for certain types of cables. This is particularly true when using thin cables that are difficult to handle because they can break during the fitting process.

EP 650 232 B1 depicts another fitting device. The generically comparable fitting tool has a fitting unit with a cable gripper on which an insertion element is arranged. The cable gripper with the insertion element is constructed in two parts and may be opened into two halves using a pivot motion. In the closed position, the cable gripper grips the cable end with the contact embodied as a connector pin. The cable end held in this way is now introduced into the connector housing, wherein the insertion element is conducted through the cable through-hole of the sealing mat. The seal may be excessively stressed or even damaged when the insertion element penetrates the cable through-hole opening, so that the sealing performance of the connector housing may be significantly weakened, especially for thinner cables. Another drawback of the devices is that the fitting unit is not very suitable for working with cables having different diameters.

SUMMARY

It is therefore an object of the present invention to avoid the disadvantages of the known devices and, in particular, to create a device for fitting connector housings provided with sealing mats to prefabricated cable ends, which filling process provides careful handling of the sealing mat and is suitable for cables that are difficult to handle. It should be simple to introduce the cable gripper having the insertion element into sealing mats in an optimized manner. The sealing mat should not be excessively stressed during the fitting process. Once the fitting process has ended, the sealing performance of the finished connector housing should satisfy stringent requirements, even when using thin cable.

These and other objects are achieved according to the invention using a device unit for fitting connector housings provided with sealing mats to prefabricated cable ends of cables comprises a fitting unit with which the cable ends may be introduced, for instance, into cells of the connector housing.

The sealing mats of the connector housing have one or more cable through-holes, each of which through-holes may receive a cable in a sealing manner. The fitting unit comprises a cable gripper having an insertion element extending along a longitudinal axis for guiding and temporarily receiving the cable. When the cable is received in the cable gripper, the cable axis corresponds to the aforesaid longitudinal axis, at least in the region of the cable end. The insertion element is designed such that it may be guided through one of the cable through-holes during the fitting process.

Since the insertion element has a widened tip, the sealing mat is handled carefully during the fitting. Undesired damage to the sealing mat that would have a negative effect on sealing performance is thus practically excluded. Due to the widening in the region of the forward end of the insertion element, which end penetrates the cable through-hole of the sealing mat first during the fitting process, the insertion element may be inserted and guided through the sealing mat simply and with surprisingly little force. Another advantage is that with this arrangement different cables may be processed with the same fitting cable gripper.

The widening of the tip should be understood geometrically and relates only to the shape of the longitudinally embodied insertion element. The insertion element may have a shaft that is connected to the tip. The radial dimensions of the shaft are reduced compared to the tip; the shaft, which is embodied longitudinally and has a sleeve-like configuration, is consequently embodied thinner than the tip. The insertion element with the widened tip may be produced in different ways. For example, the insertion element may be manufactured from a metal (e.g. steel) using casting, forming, or even cutting methods. The insertion element with the widened tip may also comprise plastic, however, and be produced in an injection molding process.

In a first embodiment, the tip may have a preferably conically tapering front region for forming a forward closure of the insertion element. The front region ensures that the tip penetrates efficiently into the cable through-hole of the sealing mat. Instead of a conical front region, the tip may also have a tapering front region having a convex or concave shape.

It may be advantageous for the tip to have a front region that tapers conically about an angle of inclination to a longitudinal axis of the cable gripper, in which front region the angle of inclination is between 40° and 80°, preferably between 50° and 70°, and particularly preferably approx. 60°. The cable through-hole may be simply and effectively spread using such a tip geometry. In addition to optimum penetration, the obtuse-angle front region permits a compact and short tip structure. The center line of cone of the tapering front region does not necessarily have to coincide with the longitudinal axis of the cable gripper.

Embodiments are also possible in which the center lines of cone from the front region are spaced apart from the longitudinal axis of the cable gripper. If the insertion element is constructed in two parts, for instance, and comprises two preferably shell-like insertion element halves, the conically tapering front region may constitute two cone halves, wherein each cone half is associated with one insertion element half. The two cone halves may each have a center line of cone, wherein the center lines of cone run parallel to the longitudinal axis. The conical shape of the front region may thus also constitute two or possibly even more segments. In the case described in the foregoing, i.e., with an insertion element having two insertion element halves, each tip would have a front region segment (cone half) that tapers conically about an angle of inclination to the corresponding parallel longitudinal center axis of cone, in which the aforesaid angle of inclination is between 40° and 80°, preferably between 50° and 70°, and particularly preferably approx. 60°.

The outer contour of the cable gripper with respect to the longitudinal axis may constitute the aforesaid front region, a center region, and a tapering end region. The center region may be embodied as a cylinder, for example. If the insertion element is constructed in two parts, and for instance comprises two preferably shell-like insertion element halves, the center region may have two cylinder surfaces. Each of these two center region cylinders may have different cylinder axes. The cylinder axes in this case are not coaxial, but rather run with their axes parallel to the longitudinal axis. The cylindrical shape of the front center region may thus also constitute two or possibly even more segments. If the front region is embodied conical, the center lines of cone and cylinder axes for the insertion element halves are preferably embodied coaxial.

The front region and the end region may have a smaller circular section than the center region, wherein the cross-sectional change in the front region and in the end region may be continuous or in steps. In addition to the design of the tip with three regions separated from one another, other shapes would also be possible for the outer contour of the tip. For instance, the tip could be spherical.

The insertion element preferably comprises a shaft and a tip that is widened compared to the shaft. The shaft is a longitudinal sleeve-like element that preferably extends in the longitudinal axis and that is thinner than the tip. The transition between tip and shaft may be formed using the aforesaid end region, for instance.

Particularly advantageously, the shaft has a cylindrical exterior. This exterior may also be a smooth cylindrical surface. It is also possible, however, to provide the exterior with profiling (for instance in the form of longitudinal ribs).

When using conventional cables having cable diameters of, for example, 1 mm to 3 mm, the longitudinal extension of the tip of the insertion element may be short and may be a maximum of 5 mm and preferably about 1 mm.

In another embodiment, the longitudinal extension of the tip may be at least seven times smaller than the length of the shaft.

The cable gripper may have two clamping jaws that may be moved toward one another for holding in a clamping. The insertion element preferably comprises two insertion element halves. The insertion element halves are preferably embodied in a shell shape. Each insertion element half has or forms a tip half and shaft half. One insertion element half may be molded onto or otherwise connected to each clamping jaw. Thus, one half of the tip and one half of the shaft are associated with each clamping jaw. The assembly of the two clamping jaws forms a clamping unit.

The cross-sectional outer contour of the tip of the insertion element may, in particular, have a pointed oval cross-sectional shape in the aforesaid two-part insertion element design.

Flat areas may be provided on radial sides of the tip in the separating gap between the insertion element halves, however. The flat areas are preferably planar areas that run parallel axially. Due to the flat areas, a shape like a type of drum is created from the pointed oval cross-sectional shape of the insertion element in the region of the flat areas.

The insertion element may furthermore be embodied essentially rotationally symmetrical, at least as seen from the outside, at least in segments, especially along the shaft.

The insertion element cross-section may have a hexagonal inner contour, at least in segments. If the insertion element is embodied in two parts like the clamping jaws and comprises two insertion element halves, the clamping jaws and each of the parts of the insertion element have separate inner contours, the sections of which form a semi-hexagon. If the insertion element has a hexagonal inner contour, this has advantages with respect to stability and service life. Moreover, a hexagonal inner contour satisfies a requirement for a wide band width for possible processable cables having different cable diameters.

The clamping jaws may have a front clamping region connected to the insertion element and a rear clamping region. The two clamping regions may be separated from one another by an interval. When the clamping jaws are closed, the cable is not acted upon across the interval.

For forming a free region in which a securely held cable is not stressed, i.e. when the clamping jaws are closed, and in particular are not received in a clamping manner using this free region, the insertion element may have an inner contour that, in cross-section (i.e., seen radially), is larger than the cross-section of the inner contour of the clamping jaws responsible for clamping the cable. Due to the enlarged cross-sectional surface area of the inner contour of the insertion element, a chamber is created in which a cable piece deformed when the cable end of the cable is pushed in during the fitting process still has enough space and permits the deformed cable piece to be received in the chamber.

It is particularly preferred that the free region of the insertion element is at least 5 mm long and preferably at least 8 mm long. The longitudinal extension of the free region is preferably about the length of the insertion element (tip and shaft). Such a long free region offers a space that is large enough for the cable deformation.

In terms of the method, the object is attained using a method in which the cables to be fitted are cables with cable ends to which contacts, such as pins, sleeves, or crimp contacts, are attached. The device described in the foregoing is preferably used for the fitting method. The fitting method comprises the following work steps: First the cable is gripped by the cable gripper of the fitting unit. The cable gripper is positioned such that the tip of the insertion element of the cable gripper is disposed behind the contact. Then the cable end of the cable is introduced by means of the fitting unit into the connector housing and preferably into the desired cell of the connector housing. The insertion element is guided through the corresponding cable through-hole and preferably through the cable through-hole belonging to the cell.

To prevent the cable from breaking, and when thin cables are used, the cable gripper preferably grips the cable immediately behind the contact or at a slight interval (particularly preferred 0.1 mm).

DESCRIPTION OF THE DRAWINGS

Further individual features and advantages of the invention are derived from the following description of an exemplary embodiment and from the drawings. The following is shown.

DETAILED DESCRIPTION

Figure 1:
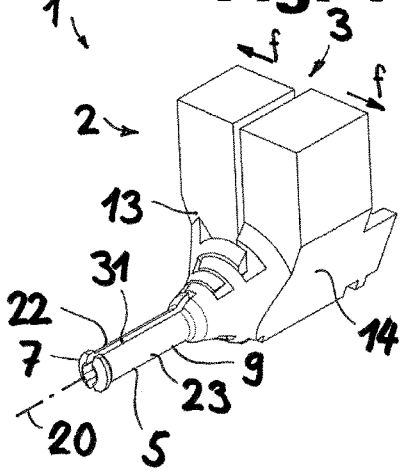
FIG. 1 is a perspective elevation view of a fitting unit having a cable gripper with an insertion element of an inventive device.

FIG. 1 depicts a device, identified overall as 1, for fitting connector housings provided with sealing mats (not shown here) to prefabricated cable ends of cables. The device 1 comprises a fitting unit 2 having a cable gripper 3. The cable gripper has two clamping jaws 13, 14 for securely holding, by clamping, a cable. Such cable grippers are also already known and commonly used, except for an insertion element 5 described in detail in the following. The clamping jaws 13, 14 may be moved in synch with one another. The opening movement, for creating an open position that permits the cable to be received, is indicated with arrows f. Naturally, however, a variant that moves on only one side would also be possible in which only one of the clamping jaws 13, 14 has to be moved to create the open position and closed position. As an example, EP 2 317 613 A1 depicts one possible embodiment of a cable gripper 3 and further details on the structural design and functioning of a cable gripper may be found therein.

The novel cable gripper 3 depicted in FIG. 1 is distinguished in that it has a specially designed insertion element 5. The insertion element 5 forms a type of extension of the cable gripper 3, which extension extends along a longitudinal axis labeled 20. The outer contour of the insertion element 5 is essentially rotationally symmetrical.

The insertion element 5 comprises a shaft 9 and a widened tip 7. This widening is to be understood to be geometrical and essentially means merely that the radial outer dimensions of the tip are greater than those of the shaft 9. In other words, the tip 7 projects radially outward compared to the shaft 9.

The insertion element 5 is a longitudinally embodied insertion part adapted to the dimensions of the through-holes of the sealing mat. The insertion element 5 with the widened tip 7 also permits the fitting of connector housings provided with particularly thick sealing mats to different cable diameters. In particular, it is possible to accomplish fitting with thin cables that have a great risk of breaking.

Like the cable gripper 3 having the two clamping jaws 13, 14 that can be moved towards one another, the insertion element 5 is embodied in two parts and has two insertion element halves 22, 23. The shaft 9 embodied like a sleeve is thus constructed from two shell-like parts. A separation gap 31 that is created due to the division of the insertion element 5 into two halves may be seen. One insertion element half 22, 23 is molded onto or otherwise connected to each clamping jaw 13, 14. For instance, the insertion element halves 22, 23 and the associated clamping jaws 13, 14 may be embodied integrally. The insertion element halves 22, 23, on the one hand, and the associated clamping jaws 13, 14, on the other hand, may be formed from separate components that are joined.

Figure 2:
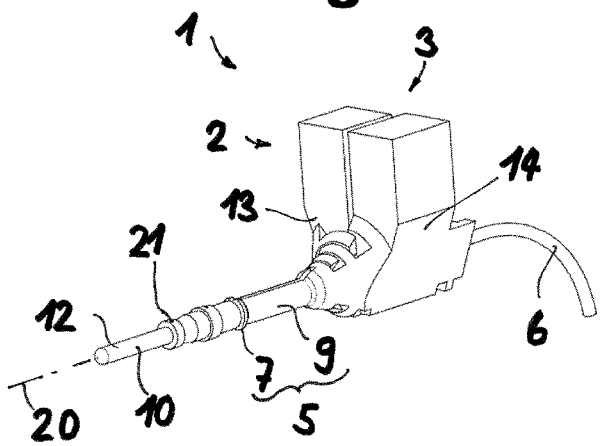
FIG. 2 depicts the insertion gripper from FIG. 1, with a cable held securely thereby, from a slightly different perspective.

FIG. 2 depicts the cable gripper 3 and a cable 6. The cable 6 has a prefabricated cable end 12, wherein primarily a contact 10 in the form of a pin is attached to the cable end 12. As may be seen from FIG. 2, the cable gripper 3 is positioned such that the tip 7 of the insertion element 5 is disposed behind the contact 10. To prevent undesired breaking of the cable 6, the cable gripper 3 is placed as close as possible to the contact 10 (see FIG. 6, below).

Figure 3:
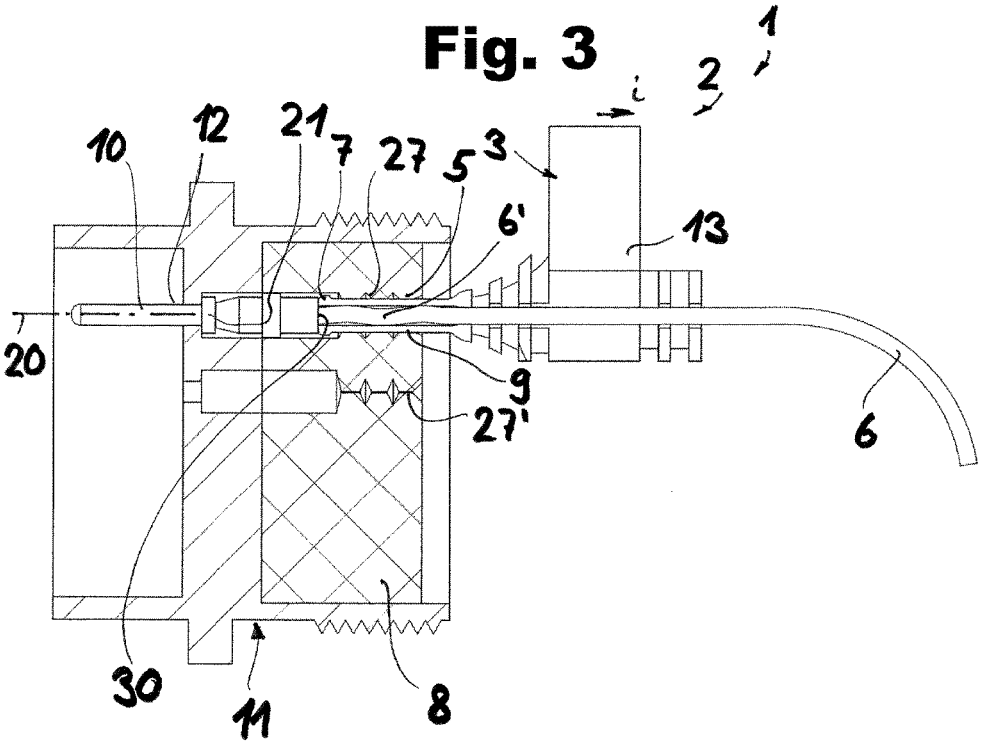
FIG. 3 depicts a section through a connector housing provided with a sealing mat, with the cable gripper, during a fitting process.

FIG. 3 depicts a connector housing 11 provided with a sealing mat 8 and having a cable gripper 3 during the fitting process. The connector housing 11 has a comparatively thick sealing mat 8 for sealing the connector housing well. Sealing mats 8 comprise an elastic material and may be made of rubber, for instance. The cable gripper 3 is disposed in an end position in which the contact 10 is completely inserted into a cell of the connector housing 11. For creating a catch mechanism for fixing the cable end 12 in place in the connector housing 11, the contact 10 has a collar 21 that cooperates with detent means (not shown here) of the connector housing.

As may be seen from FIG. 3, in the end position the insertion element 5 is conducted through a cable through-hole 27 belonging to the cell. After attaining the end position and locking the contact 10 in the connector housing, the clamping gripper is opened slightly, whereupon, due to movement in the direction of the arrow i, the insertion element 5 may be withdrawn from the cable through-hole 27 again without withdrawing the cable or damaging the sealing mat. A second cable through-hole prior to the fitting process, identified with 27', may be seen in FIG. 3. As may be seen, in its original state the through-hole 27' is embodied very narrow to ensure optimum sealing. The sealing region of the cable through-hole 27 is disposed on the shaft 9 when the insertion element is conducted therethrough. In this position, the widened tip 7 is disposed in a large chamber and is not in contact with the sealing mat 8.

Figure 6:
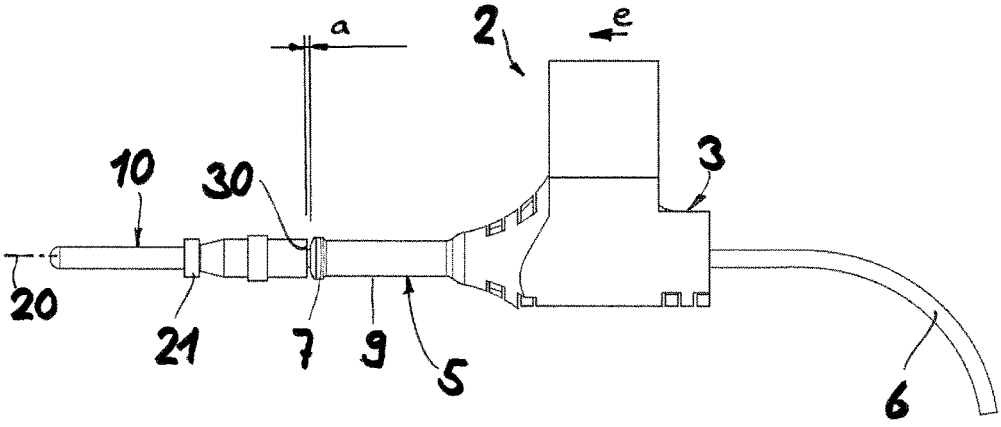
FIG. 6 is a side view of the cable gripper with the gripped cable from FIG. 2.
Figure 7:
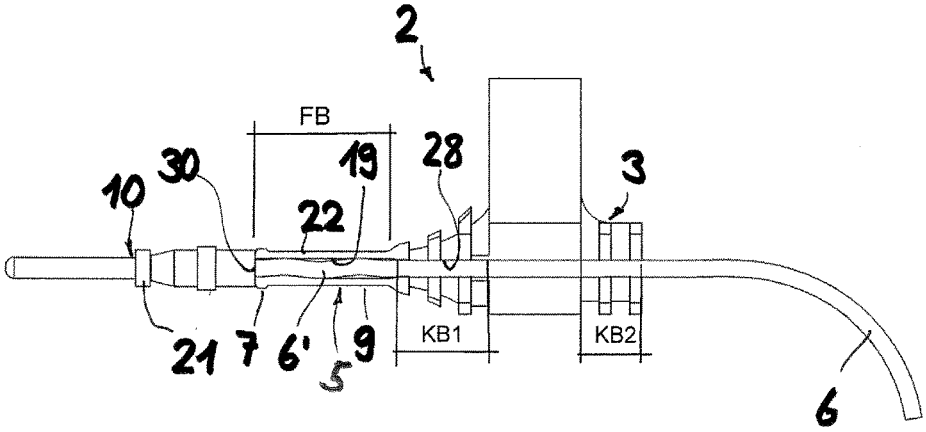
FIG. 7 is a side view of the cable gripper during the fitting process.

The method for fitting connector housings 11 provided with sealing mats 8 to prefabricated cable ends 12 of cables 6, wherein contacts 10 are attached to the cable ends 12, comprises the following method steps: The cable gripper 3 of the fitting unit 2 grips the cable 6. The cable gripper 3 is positioned relative to the cable end 12 such that the tip 7 of the insertion element 5 is disposed behind the contact 10. Especially when thin cables are used, the cable gripper 3 grips the cable 6 immediately behind the contact 10 or at a slight interval (a=0.1 mm) (FIG. 6). Then the cable end 12 held securely in this manner is inserted by means of the fitting unit 2 into the desired cell of the connector housing 11, wherein the insertion element 5 is conducted through the cable through-hole 27 belonging to the cell. The cable gripper 3 presses the contact 10 through the sealing mat to the locked position using the insertion element 5 (FIG. 3). During this process the cable piece 6' of the cable inside the insertion element 5 is deformed slightly. The free region FB associated with the insertion element 5 is designed to permit such deformation (see also FIG. 7). The permitted deformation of the cable 6' in the insertion element ensures that any potential interval a between the support tip and the rear part of the contact is eliminated in an advantageous manner (see FIG. 6). In the connector, the cable gripper 3 opens wide enough that it may be withdrawn from the sealing mat 8 without pulling out the cable 6 and without damaging the cable 6 or the sealing mat 8.

The method differs as follows for relatively thick cables or cables that have a low risk of breaking: The cable 6 is managed in the preliminary process such that the cable gripper 3 grips the cable 6 far enough back that fitting occurs without the insertion element 5 penetrating into the sealing mat 8. The cable gripper 3 is thus positioned far enough from the contact 10 that the cable gripper 3 does not touch the sealing mat 8 in the end position or locked position.

Figure 4:
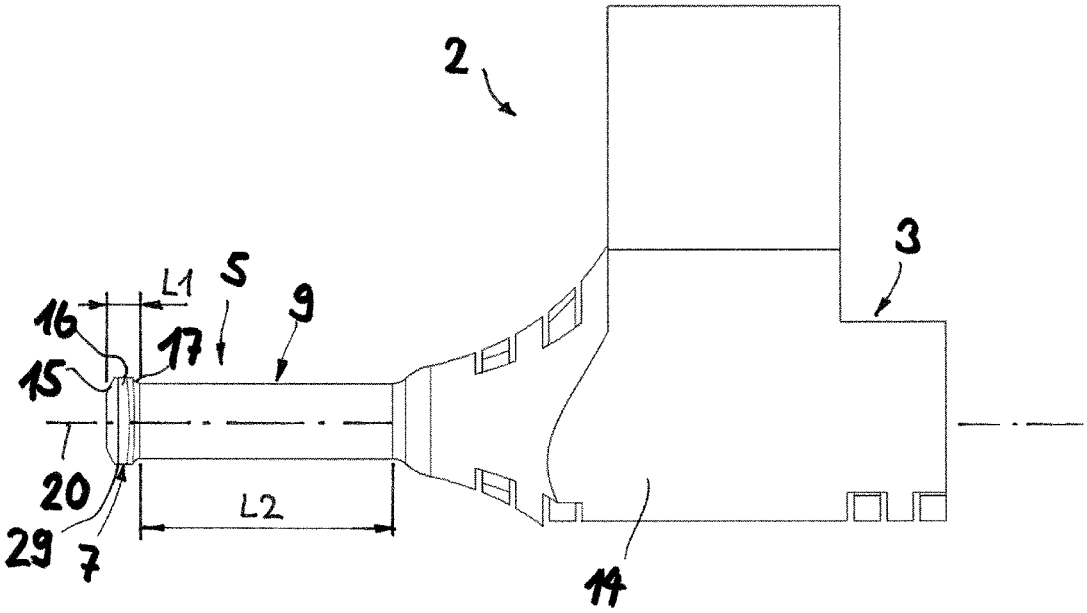
FIG. 4 is an enlarged side view of the fitting unit.

Additional technical details for structural design of cable gripper 3 for the fitting unit 2 for the device 1 are shown in FIGS. 4 through 9. FIG. 4 depicts the cable gripper as seen from the side. In the side view, the tip 7 has an outer contour divided into three regions. The tip 7 comprises a front region 15, a center region 16, and an end region 17. The front region 15 is embodied conical. The center region 16 is embodied cylindrical except for the upper and lower radial sides at the separation gap 31. The tip 7 has a flat area 29 in the aforesaid upper and lower sides. Due to the flat area 29, there are no sharp edges, which prevents undesired damage to the sealing mat during the fitting process. The end region 17 creates a transition to the shaft 9.

Figure 9:
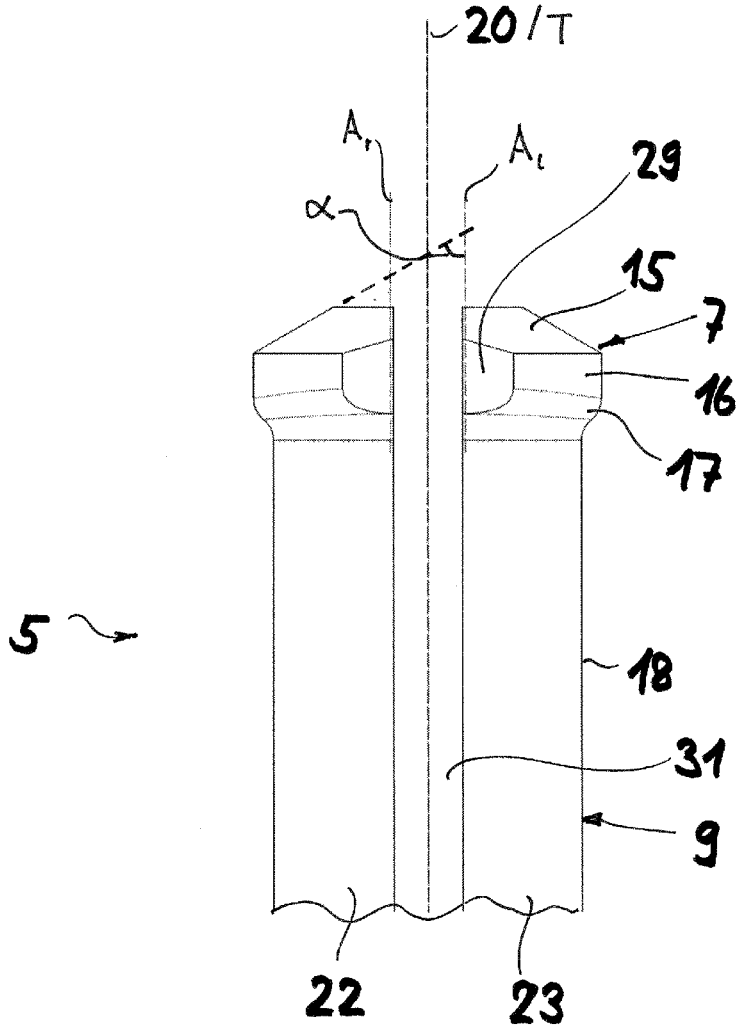
FIG. 9 is a much-enlarged top view of a front region of the insertion element.

As may be seen, in particular, from FIG. 9, the end region 17 has a curved course, with curves, tapering toward the shaft 9. The length of the insertion element 5 should be determined by the insertion length required by the embodiment of the connector housing and sealing mat. The extensions of the tip 7 and of the shaft 9 relative to the longitudinal axis 20 are identified as L1 and L2. The longitudinal extension L1 of the tip 7 is much shorter than the length L2 of the shaft 9. The longitudinal extension L1 of the tip 7 for cables having a cable diameter of, for example 1 mm to 3 mm, is between 1 mm and 5 mm. For example, if cables having a cable diameter of 1.8 mm or having even smaller cable diameters are used, the length extension L1 may be 1 mm, the length L2 of the shaft 9 may be 6 to 8 mm, for example.

The shaft 9 has a cylindrical exterior 18 (see FIG. 9), wherein the exterior is smooth. As an alternative to a smooth surface, however, profiles, such as longitudinal ribs, for instance, may be provided on the exterior, as well.

Figure 5:
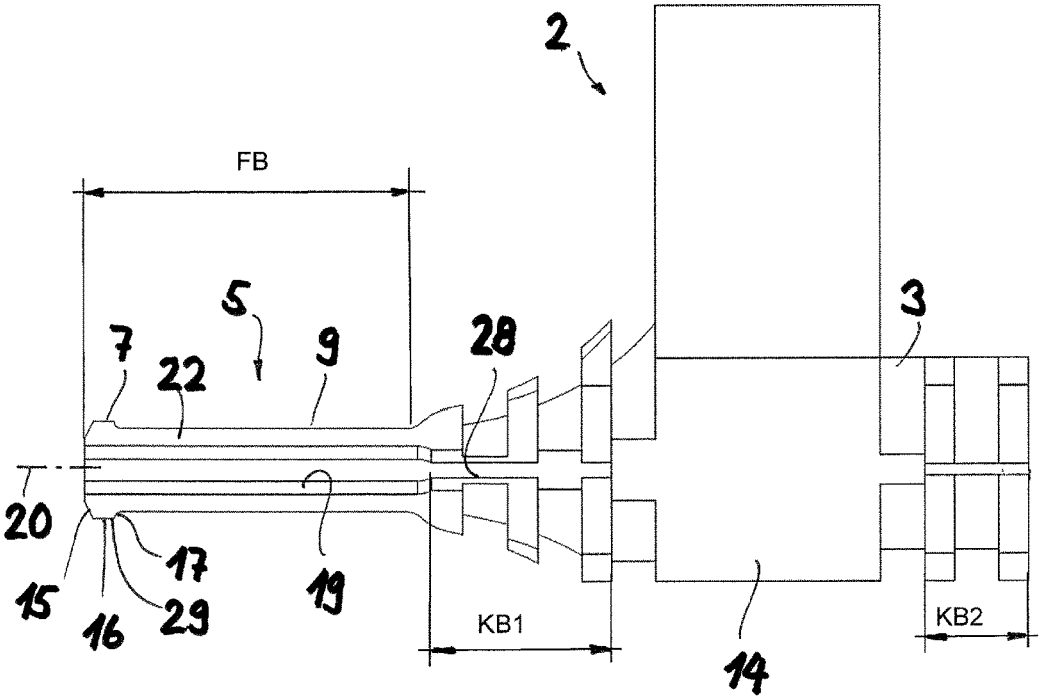
FIG. 5 is a side view of the fitting unit according to FIG. 4 wherein half of the fitting unit is not shown.

FIG. 5 depicts the same cable gripper 3 as in FIG. 4, but in this case the clamping jaw facing the observer and having the element half molded thereon has been removed or is not shown, so that the interior of the cable gripper 3 is visible. Thus, it may easily be seen from FIG. 5 that the inner contour 19, which forms the chamber in the free region FB for accommodating the cable (not shown), of the insertion element 5 is larger than the inner contour 28 of the clamping unit made of the clamping jaws 13,14.

The clamping jaws have two clamping regions, labeled "KB1" and "KB2", for clamping the cable 6 that are narrower, at least in the segments responsible for clamping the cable. The front clamping region KB1 connecting to the insertion element 5 is separated from the rear clamping region KB2 by an interval.

FIG. 6 depicts the cable gripper 3 prior to adding the contact 10 to the corresponding cable through-hole (not shown) of the connector housing. Prior to the beginning of the actual fitting process, the cable gripper 3 secures the cable 6 in a position in which, although the insertion element 5 is placed near to the contact, there is still a small interval. This interval, that is the distance from a back side 30 of the contact 10 to the front end face of the tip 7 of the insertion element 5, is identified as a. The interval a may be 0.1 mm, for example. During the fitting process, if the contact 10 is inserted completely into the corresponding cell of the connector housing, the interval a is eliminated and the insertion element 5 bumps up against the contact 10 and presses there against. The direction of insertion is indicated with an arrow e in FIG. 6. Due to this reduction in distance, the cable 3 experiences a deformation that may be accommodated in an enlarged chamber within the insertion element 5.

FIG. 7 again depicts the end position when the cable end (not shown here) has been completely inserted into the proper cell of the connector housing, in which position the insertion element 5 bumps up against the contact 10.

For forming the free region FB in which the cable is not loaded and in particular is not clamped, the insertion element 5 has the aforesaid inner contour 19, which in cross-section is larger than the inner contour 28, responsible for clamping the cable, of the clamping jaws 13, 14. Because of this, an enlarged chamber is created in which a cable piece, identified as 6', that is deformed by compression when the cable end is inserted during the fitting process, may be accommodated. The free region FB may be at least 5 mm long and preferably at least 8 to 9 mm long. The free region FB permits the held cable 6 to deform enough that the interval a between the contact 10 and tip 7 is eliminated.

Figure 8:
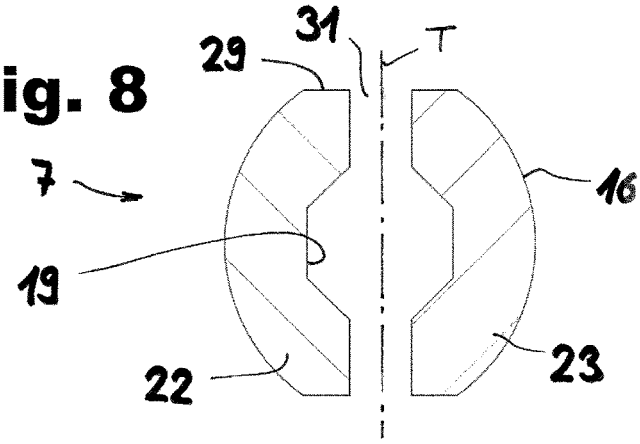
FIG. 8 is a section through a tip of the insertion element of the cable gripper.

From FIG. 8 it may be seen that the insertion element 5 has a hexagonal inner contour 19. A line T indicates a separation plane that is disposed between the halves of the cable gripper and the insertion element 5. The separation plane T primarily also defines a plane of symmetry. Each of the parts 22, 23 of the insertion element 5 has an inner contour that in cross-section forms a semi-hexagon. The hexagonal inner contour 19 weakens the insertion element 5 significantly less than the conventional rectangular inner contours.

Moreover, the flat areas 29 may be seen on upper and lower radial sides of the tip in FIG. 8. The flat areas 29 are planar surfaces. The planar parallel flat areas 29, which run axially, are disposed on opposing sides of the separating gap 31. The flat areas 29 are thus oriented at right angles to the separation plane T that divides the two halves of the insertion element. In other words, the tip 7 is shortened at the top and at the bottom. Due to the tip 7 shortened in this manner in the cross-section in FIG. 8, it is assured that because there are no sharp edges the sealing mat is not damaged when it is penetrated.

In addition to the flat areas 29, that is in the front region 15 and in the end region 17, the tip 7 has a pointed oval outer contour in cross-section. Due to the flat areas 29, a shape for the outer contour like a type of drum occurs from the pointed oval cross-sectional shape of the tip 7 of the insertion element 5 in the region of the flat areas 29.

Details of the pointed geometry of the widened tip 7 may be seen in FIG. 9. With respect to a longitudinal axis 20, the outer contour of the tip 7 comprising the front region 15, the center region 16, and the end region 17 is embodied in a manner that protects the sealing material. Also shown in FIG. 9 as a is the angle of inclination of the left half of the conically tapering front region 15 to the associated axis $A_l$, which runs parallel to the longitudinal axis 20. This angle of inclination $\alpha$ in this exemplary embodiment is approximately 60°.

The end region 17 constitutes two roundings having approximately equal radii. The end region shaped in this manner ensures that the sealing mat is also not damaged when the insertion element 5 is withdrawn. Naturally it is also possible for the end region 17 to be embodied conical like the front region.

The insertion element has a conical tip 7, wherein the right and left gripper sides each have discrete axes of cone $A_r$, $A_l$. The axes $A_r$, $A_l$ are spaced apart from one another, so that the axis of cone $A_r$ of the right gripper side is positioned on the left side of the line of symmetry T and the axis of cone $A_l$ of the left gripper side is positioned on the right side of the line of symmetry T. This makes it possible for the contact attached to the cable end to be guided over defined points and permits enough freedom about the contact for finely adjusting it as soon as its tip touches the sealing mat of the connector housing. The contact is tilted about the point of contact to the connector housing in that the cable gripper changes its position until the contact is correctly oriented to the connector housing.

In its center region 16 the outside of the tip 7 has two cylinder surfaces, each of which is interrupted by flat areas 29. Each of these two center region cylinders has different cylinder axes $A_r$, $A_l$ that coincide with the associated aforesaid axes of cones $A_r$, $A_l$. Without the flat areas 29, the cross-section of the tip 7 would obviously have a pointed oval shape in the center region 16.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for fitting a connector housing provided with a sealing mat to a prefabricated cable end of a cable, the device having a fitting unit with which the cable end is introduced into the connector housing during a fitting process, the fitting unit comprising: a cable gripper for gripping the cable and having an insertion element that during the fitting process is guided through a cable through-hole of the sealing mat, the insertion element having a shaft and a tip, the tip being wider than the shaft, and the tip being disposed behind a contact on the cable end when the cable gripper is gripping the cable;

wherein the shaft has a cylindrical exterior that is connected to the tip.

2. The device according to claim 1 wherein the tip has a tapering front region.

3. The device according to claim 1 wherein the tip has a front region tapering conically about an angle of inclination relative to a longitudinal axis of the cable gripper or relative to an axis of cone running parallel to the longitudinal axis, wherein the angle of inclination is between 60° and 80°.

4. The device according to claim 1 wherein the tip has a tapering front region, a center region, and an end region, the end region tapering toward the shaft.

5. The device according to claim 1 wherein a longitudinal extension of the tip is at least seven times shorter than a length of the shaft.

6. The device according to claim 1 wherein a longitudinal extension of the tip is in a range of 1 mm to 5 mm.

7. The device according to claim 1 wherein that in cross-section the insertion element has a hexagonal inner contour.

8. The device according to claim 1 wherein for forming a free region permitting deformation of the cable, the insertion element has an inner contour that in cross-section is larger than an inner contour of clamping jaws of the cable gripper.

9. The device according to claim 8 wherein the free region has a length in a range of 5 mm to 8 mm.

10. The device according to any of claim 1 wherein the cable gripper has two clamping jaws that are movable relative to one another for gripping the cable, the tip and the shaft of the insertion element comprise two insertion element halves, and each of the insertion element halves is joined to or integral with an associated one of the clamping jaws.

11. The device according to claim 10 including flat areas formed on radial sides of the tip at a separating gap between the insertion element halves.

12. The device according to claim 1 wherein in cross-section an outer contour of the tip has a pointed oval shape.

13. A method for fitting a connector housing provided with a sealing mat to a prefabricated cable end of a cable, wherein a contact is attached to the cable end, comprising the following method steps:

providing a fitting unit having a cable gripper for gripping the cable and having an insertion element that during the fitting is guided through a cable through-hole of the sealing mat, the insertion element having a shaft having a cylindrical exterior that is connected to a tip, the tip being wider than the shaft;

gripping the cable with the cable gripper of the fitting unit, wherein the cable gripper is positioned such that the tip of the insertion element is disposed behind the contact; and inserting the cable end of the cable, using the fitting unit, into the connector housing, wherein the insertion element is guided through the cable through-hole into the sealing mat.

* * * * *